US008945492B2

(12) United States Patent
Ospanov et al.

(10) Patent No.: US 8,945,492 B2
(45) **Date of Patent: *Feb. 3, 2015**

(54) METHOD FOR EXTRACTION OF BERYLLIUM FROM THE MINERALS OF GENTHELVITE GROUP WHEN PROCESSING THE RAW MINERALS (ORES, CONCENTRATES)

(71) Applicants: Habibulla Kusainovich Ospanov, Almaty (KZ); Galimkair Mutanovich Mutanov, Almaty (KZ); Beibit Zholdybaevich Arinov, Ust-Kamenogorsk (KZ); Serik Kasymovich Kozhahmetov, Almaty (KZ); Aishagul Batyrbekovna Baiboldieva, Almaty (KZ); Nazira Habibyllakyzy Ospanova, Almaty (KZ); Vera Anatolevna Rybakova, Ust-Kamenogorsk (KZ)

(72) Inventors: Habibulla Kusainovich Ospanov, Almaty (KZ); Galimkair Mutanovich Mutanov, Almaty (KZ); Beibit Zholdybaevich Arinov, Ust-Kamenogorsk (KZ); Serik Kasymovich Kozhahmetov, Almaty (KZ); Aishagul Batyrbekovna Baiboldieva, Almaty (KZ); Nazira Habibyllakyzy Ospanova, Almaty (KZ); Vera Anatolevna Rybakova, Ust-Kamenogorsk (KZ)

(73) Assignee: Kazakh National University named after Al-Farabi, Almaty (KZ)

( * ) Notice: Subject to any disclaimer, the term of this patent is extended or adjusted under 35 U.S.C. 154(b) by 91 days.

This patent is subject to a terminal disclaimer.

(21) Appl. No.: 13/864,385

(22) Filed: Apr. 17, 2013

(65) Prior Publication Data

US 2014/0314640 A1 Oct. 23, 2014

(30) Foreign Application Priority Data

Apr. 18, 2012 (KZ) ..... 2012/0454

(51) Int. Cl.
*C22B 59/00* (2006.01)
*C22B 35/00* (2006.01)

(52) U.S. Cl.
CPC ..... *C22B 35/00* (2013.01)
USPC ..... 423/132

(58) Field of Classification Search
None
See application file for complete search history.

(56) References Cited

U.S. PATENT DOCUMENTS

| | | | | | |
|---|---|---|---|---|---|
| 1,823,864 | A | * | 9/1931 | Sawyer et al. | 423/132 |
| 1,982,873 | A | * | 12/1934 | James | 423/127 |
| 1,998,685 | A | * | 4/1935 | Panebianco et al. | 423/127 |
| 2,092,621 | A | * | 9/1937 | Kjellgren et al. | 423/132 |
| 2,459,895 | A | * | 1/1949 | Schormuller | 423/128 |
| 3,177,068 | A | * | 4/1965 | Mod et al. | 423/132 |
| 3,395,975 | A | * | 8/1968 | Grunig et al. | 423/132 |
| 3,511,597 | A | * | 5/1970 | Surls, Jr. et al. | 423/128 |
| 3,669,649 | A | * | 6/1972 | Olson et al. | 423/132 |
| 3,685,961 | A | * | 8/1972 | Grunig et al. | 423/127 |
| 3,699,208 | A | * | 10/1972 | Grunig et al. | 423/132 |
| 3,704,091 | A | * | 11/1972 | Grunig et al. | 423/128 |
| 3,729,541 | A | * | 4/1973 | Grunig et al. | 423/112 |

FOREIGN PATENT DOCUMENTS

GB 502987 * 3/1939

* cited by examiner

*Primary Examiner* — Steven Bos
(74) *Attorney, Agent, or Firm* — Nadya Reingand

(57) ABSTRACT

The invention relates to non-ferrous metallurgy and is used for extracting beryllium from genthelvites when processing the raw minerals (ores, concentrates) by heap and vat leaching. The objective of the invention is to disclose a method of leaching beryllium from danalite ($Fe_8(BeSiO_4)6S_2$), genthelvite ($Zn_8(BeSiO_4)6S_2$), and helvite ($Mg_8(BeSiO_4)6S_2$), thus expanding the range of raw minerals used for processing and providing more economical production and improved environmental impact via use of an effective reagent at low temperatures by hydrochemical method. The offered method is beneficial both economically and ecologically, as the alternate modern pyrometallurgical method of beryllium extraction has the following drawbacks: emission of toxic gases, high energy requirements, and use of the fireproof materials. The newly developed method is recommended as a basis for the innovative technology of beryllium extraction from genthelvite concentrates and ores.

7 Claims, No Drawings

METHOD FOR EXTRACTION OF BERYLLIUM FROM THE MINERALS OF GENTHELVITE GROUP WHEN PROCESSING THE RAW MINERALS (ORES, CONCENTRATES)

CROSS-REFERENCE TO RELATED APPLICATIONS

This invention claims priority to, and incorporates by reference, Kazakhstan Patent Application No. 2012/0454.1, filed Apr. 18, 2012, now issued as a Patent No. KZ 26589.

FIELD OF THE INVENTION

The claimed invention relates to the field of non-ferrous metallurgy and can be used for extracting beryllium from genthelvites when processing the raw minerals (e.g. ores, concentrates) by heap and vat leaching.

BACKGROUND

Modern methods of beryllium extraction from the minerals mentioned above, in particular, from ore and concentrates, all exclusively use the pyrometallurgical method at high temperature. Processing of the beryllium-containing ore can be accomplished in several ways: (a) Melting with alkalis; (b) Sintering, with sodium fluorosilicate in different variations; (c) Chlorination (using chlorine gas) with charcoal at a temperature of approximately 800° C.; (d) Roasting the concentrate at a temperature of 1400-1500° C. (US method); (e) Melting-cooling in an electric furnace at 1600-1650° C.

Disadvantages of beryllium extraction by the pyrometallurgical production method include: release of harmful toxic gases, high energy costs, and need for fire-resistant materials, all of which are not economically or environmentally beneficial.

With regard to this, there is presently a great urgency to develop new technologies for processing beryllium-containing raw materials by hydrochemical method and to search for new effective active reagents tor extracting beryllium minerals that are difficult to dissolve.

SUMMARY OF THE INVENTION

A more economical and environment-friendly process (compared to known methods) for extraction of beryllium from raw beryllium-containing minerals of the genthelvite group (i.e. danalite, genthelvite, helvite). The process employs the use of a leaching solution containing technical grade hydrochloric acid at concentrations in the range of 0.8%-8% (by weight) per liter of leaching solution. The leaching solution is placed in contact with the genthelvite material and heated at 80° C. for one (1) hour, allowing for extraction of beryllium from the beryllium-containing minerals.

DETAILED DESCRIPTION OF THE PREFERRED EMBODIMENT

Replacement of the high temperature method for extracting beryllium from beryllium-containing raw materials, presented mainly in the form of mineral groups of the genthelvite group (danalite, genthelvite, helvite), then chrysoberyl (Be(AlO2)2), euclase (Al2Be2(Si2O8)(OH)2), bertrandite (Be4(Si2O8)(OH)2), then bavenite (Ca4(BeAl2Si9)25)(OH)2, phenakite (Be2Si6O4), and lastly the beryllium concentrates using the cheaper hydrochemical method with effective solvents is very urgent.

Since there is interest abroad in genthelvites as promising sources of raw material, they form the basis of genthelvite concentrates.

The basis of this invention is the disclosure of a novel method for extracting beryllium from danalite (Fe8(BeSiO4)6S2), helvite (Mg8(BeSiO4)6S2), and genthelvite (Zn8(BeSiO4)6S2), thus expanding the range of raw minerals used for processing and providing more economical production and improved environmental impact via use of an effective active reagent at low temperatures by hydrochemical method. This method has no analogs in worldwide application.

The main objective of the invention is beryllium extraction from the genthelvite group of minerals (ores, concentrates), providing economical, environment-friendly production via use of the cheap hydrochemical method.

The technical result is achieved by leaching beryllium from minerals of the genthelvite group (danalite, helvite, and genthelvite) by immersing monomineral samples of ore or concentrates in the leaching solution. Such solution contains technical hydrochloric acid in quantities of 1.2% to 8% by weight (the ratio of HCl:H2O is 1:3) per 200 mL of solution. The samples are then boiled in solution at a temperature of 80° C. for 1 hour (i.e. leaching beryllium from the given product occurs in a very small period of time). The role of hydrochloric acid is two-fold: to ensure that it inhibits hydrolysis, and also to ensure that stable bonding of BeCl2 occurs.

Experimental studies have been performed on the dissolution in hydrochloric acid of monomineral samples of beryllium-containing minerals. The mineral purity is as follows: helvite—99.1; genthelvite—99.0; chrysoberyl—98.4; bertrandite—98.5; phenakite—98.3; beryl—99.0.

Verification of the data was conducted on monomineral samples of danalite, helvite, and genthelvite with concentrations of hydrochloric acid from 0.8 to 8% (by weight). These experiments showed that when the concentration of hydrochloric acid is 0.8%, 31% of beryllium is extracted from helvite, 22% from genthelvite, and 25% from danalite (Table 1). Only increasing the HCl concentration up to 5% and higher leads to complete dissolution of beryllium.

TABLE 1

Beryllium extraction (in %) from danalite, helvite, and genthelvite depending on the concentration of hydrochloric acid. Mineral portion is 100 mg. Volume of solution is 200 mL.

| | Concentration of hydrochloric acid, % | | | | | |
|---|---|---|---|---|---|---|
| | 0.8 | 1.2 | 2.4 | 5.0 | 8.0 | 12.0 |
| Minerals | Beryllium extraction from minerals, % | | | | | |
| Helvite | 31.0 | 42.6 | 60.2 | 100 | 100 | 100 |
| Genthelvite | 22.4 | 39.4 | 54.6 | 100 | 100 | 100 |
| Danalite | 25.0 | 40.0 | 60.0 | 100 | 100 | 100 |

The preliminary experimental results on the behavior of helvite, genthelvite, and danalite relative to the concentration of hydrochloric acid yielded information about the primary factors influencing the process being studied: concentration of hydrochloric acid, mixing duration, and temperature.

The ratio of components, including concentrations of potassium chlorate and hydrochloric acid used during leaching, was chosen experimentally using the multifactor orthogonal experiment design. Deviations from the design lead to decreases in the degree of beryllium extraction from beryllium-containing raw materials.

To confirm the technical result of the claimed method, there are several examples of implementation: experiments were performed in a 500 mL leaching solution corresponding to the S:L ratio of 1:5. The degree of extraction was measured by existing methods.

EXAMPLE 1

Pour 500 mL of technical hydrochloric acid with concentration of 8% (by weight) onto 250 g of monomineral helvite or genthelvite. Components were heated to 80° C. for 1 hour. Results of the experiment are shown in Table 2.

EXAMPLE 2

Test was conducted similarly to Example 1, except with a technical hydrochloric acid concentration of 6% (by weight). Results are shown in Table 2.

EXAMPLE 3

Test was conducted similarly to Examples 1-2, except with a technical hydrochloric acid concentration of 2.4% (by weight). Results are shown in Table 2.

EXAMPLE 4

Test was conducted similarly to Examples 1-3, except with a technical hydrochloric acid concentration of 1.2% (by weight). Results are shown in Table 2.

On the basis of the experimental data (Table 2), the following most effective sets of optimal conditions for extracting beryllium from helvite and genthelvite were chosen: 500 mL of 5-8% solution of hydrochloric acid heated for 60 minutes. Under these conditions, the degrees of beryllium extraction from helvite and genthelvite were determined, and they were 100%.

TABLE 2

Results of the multifactor experiment of the 2nd order $\alpha = \pm 1.215$. Experiments were conducted separately for helvite and genthelvite on the same planning matrix. 500 mg portion.

| | | Test conditions: hydrochloric acid of various concentrations: heated to 80° C. for 1 hour. Beryllium extraction in % | | | |
|---|---|---|---|---|---|
| No | Beryllium minerals, % | Example 1 (8% HCl by weight) | Example 2 (6% HCl by weight) | Example 3 (2.4% HCl by weight) | Example 4 (1.2% HCl by weight) |
| 1 | Helvite | 100; 100; 100; 100; 100; 100 | 100; 100; 100; 100; 100; 99 | 58.2; 58.5; 58.6; 57.0; 57.5; 57.2 | 42.0; 41.5; 41.0; 41.5; 42.0 |
| 2 | Genthelvite | 100; 100; 100; 100; 99; 99 | 100; 100; 100; 99.2; 99.5; 99.8 | 57.2; 57.9; 57.5; 58.1; 57.3; 58.3 | 42.0; 40.9; 40.8; 40.5; 41 |

From Tables 1 and 2 it follows that the claimed method allows carrying out the process in a hydrochloric acid medium (in concentrations ranging from 5% and higher) heated to a temperature of 80° C. for 1 hour. Beryllium extraction ranges from 99% to 100%. The claimed method for leaching beryllium from the group of genthelvites was also tested by the addition of certain amounts of monomineral samples of helvite or genthelvite to ore with original content of 0.028%. Leaching method: separately add 500 mg of monomineral helvite or genthelvite to a batch of 0.25 kg of ore. Then, pour 500 mL of hydrochloric acid of various concentrations into the mixture and heat on a stove for 1 hour. The mixture was cooled and then filtered through a filter. Beryllium content was determined by spectrophotometric method with beryllium II. Results are shown in Table 3, below.

Since danalite, helvite, and genthelvite have almost identical chemical activity, tests were only conducted with helvite. Verification of the degree of beryllium extraction from danalite and genthelvite showed it is also 100% for the optimum conditions for helvite dissolution discovered.

TABLE 3

Results of validation of beryllium extraction from ore with original content of 0.028% with added monomineral helvite samples. The hitch - 0.250 kg of ore. Volume of the solution - 500 mL. Hydrochloric acid - 8% (by weight) heated to 80° C. The results are averages of the four experiments.

| Total Be content of ore, % | Total Be content of ore in batch 0.250 kg, mg | Added helvite, mg | Be content of enumeration of 500 mg helvite batch, mg | Total value of Be found in ore in the presence of helvite mg | % |
|---|---|---|---|---|---|
| 0.028 | 70 | 500 | 24.335 | 94.0 | 99.6 |

A new method for extracting beryllium from the genthelvite group of minerals in the context of processing mineral raw materials (ore, concentrate) may be recommended as the basis for innovative technologies for beryllium extraction from genthelvite concentrates and ores.

It will be understood by those skilled in the art that various changes in form and details may be made therein without departing from the spirit and scope of the invention as set forth in the appended claims. Those skilled in the art will recognize, or be able to ascertain using no more than routine experimentation, many equivalents to the specific embodiments of the invention described herein. Such equivalents are intended to be encompassed in the scope of the claims.

What is claimed is:

1. A process for extraction of beryllium from beryllium-containing raw minerals or beryllium-containing material, comprising:

first, contacting the beryllium-containing raw minerals or material with a leaching solution, comprising technical grade hydrochloric acid, and second, extraction of beryllium, comprising the use of technical grade hydrochloric acid as a solvent in quantities of 0.8%-8% by weight per liter of leaching solution and heating at 80° C. for one (1) hour, to solubilize said raw minerals or material.

2. The process of claim 1, wherein the leaching solution further comprises a hydrochloric acid to water concentration ratio of 1:3.

3. The process of claim 1, wherein the beryllium-containing mineral is danalite, genthelvite or helvite.

4. A process for extraction of beryllium during processing of beryllium-containing raw minerals or material, comprising: contacting the beryllium-containing raw minerals or material with leaching solution, comprising water, potassium chlorate, and technical grade hydrochloric acid, and heating said minerals or material with said solution together for a period of one (1) hour.

5. The process of claim 4, wherein the leaching solution is comprised of technical grade hydrochloric acid in quantities of 0.8%-8.0% by weight per liter of total leaching solution.

6. The process of claim 4, further comprising a heating temperature of 80° C.

7. The process of claim 4, wherein the beryllium-containing mineral is danalite, genthelvite, or helvite.

* * * * *